US006237972B1

(12) United States Patent
Jung

(10) Patent No.: US 6,237,972 B1
(45) Date of Patent: May 29, 2001

(54) ANIMAL WASTE COLLECTION DEVICE

(76) Inventor: Koock Elan Jung, 564 Lockhart Mountain Rd., Lake George, NY (US)

( * ) Notice: Subject to any disclaimer, the term of this patent is extended or adjusted under 35 U.S.C. 154(b) by 0 days.

(21) Appl. No.: 09/546,878

(22) Filed: Apr. 10, 2000

(51) Int. Cl.[7] ..... A01K 29/00; E01H 1/12
(52) U.S. Cl. ..... 294/1.4; 15/257.3
(58) Field of Search ..... 294/1.3, 1.4, 1.5, 294/50.9; 15/257.1, 257.3, 257.6

(56) References Cited

U.S. PATENT DOCUMENTS

| | | | | |
|---|---|---|---|---|
| 3,197,597 | * | 7/1965 | Lasch, Jr. | 294/1.4 |
| 4,042,269 | * | 8/1977 | Skermetta | 294/1.5 |
| 4,741,566 | * | 5/1988 | Byung-Do et al. | 294/1.4 |
| 4,958,871 | | 9/1990 | Hemans | 294/1.3 |
| 5,031,277 | * | 7/1991 | Coker | 15/257.3 |
| 5,320,393 | * | 6/1994 | Cortinas | 294/1.4 |
| 5,335,952 | | 8/1994 | Clapper | 294/1.4 |
| 5,350,208 | | 9/1994 | Heinrichson | 294/1.4 |
| 5,370,431 | | 12/1994 | Henninger | 294/1.4 |
| 5,380,054 | * | 1/1995 | Galvis | 294/1.4 |
| 5,503,442 | * | 4/1996 | Lee | 294/1.4 |
| 5,540,470 | * | 7/1996 | Lu | 294/1.4 |
| 5,667,264 | | 9/1997 | Tanahara | 294/1.4 |
| 5,671,959 | * | 9/1997 | Tsou | 294/1.4 |
| 5,895,082 | * | 4/1999 | Kaluzny | 294/1.4 |
| 6,068,311 | * | 5/2000 | Jones | 294/1.4 |
| 6,135,520 | * | 10/2000 | Miller et al. | 294/1.4 |
| 6,164,710 | * | 12/2000 | Shibuya | 294/1.5 |

* cited by examiner

*Primary Examiner*—Dean J. Kramer
*Assistant Examiner*—Paul T. Chin

(57) ABSTRACT

An animal waste collection device allows collection of waste into a bag without soiling a user. The animal waste collection device comprises an elongated handle that comprises an actuator assembly at one end; a pick-up and collection device disposed at the other end of the elongated handle and comprising an elongated cylindrical member and a closure member to define a slot-like aperture in which the closure member is adapted to be moved between an open and closed position to provide access to the interior of the pick-up and collection device through the slot-like aperture; a linkage operably connected at a first end to the actuator assembly and extending between the actuator assembly and the pick-up and collection device; a transmission element operably connected to the linkage at the pick-up and collection device. The transmission element is operably connected to the closure member for transmitting movement from the actuator assembly to move the closure member between open and closed closure member positions. A bag is provided for receiving and storing animal waste and comprises a closed and open end and a slot that is complementary to the slot-like aperture where the open end of the bag is complementary to the elongated cylindrical member. The open end of the bag can be secured to one end of the elongated cylindrical member and the closure member to provide access to the interior of the bag when the actuator assembly moves the closure member to the open position for collecting waste.

16 Claims, 5 Drawing Sheets

ANIMAL WASTE COLLECTION DEVICE

BACKGROUND OF THE INVENTION

The invention relates to an animal waste collection devices and methods. In particular, the invention relates to an animal waste collection devices and methods that are used in combination with a bag for collecting, storing, and disposing of the animal waste.

It has been said that the American population is outnumbered by their pets. We are said to be outnumbered by our pet dogs alone, which number more than 250 million by some estimates. As these numbers increase, the public demand for animal regulation increases correspondingly, responsive to the public health and safety concerns related to the high population of pet animals.

Generally, pet owners residing in municipal regions are subject to ordinances requiring that their animals be leashed at all times in public, and restrained in private to prevent uncontrolled wandering. Recently, some municipalities have promulgated so-called "pooper-scooper" ordinances, which require pet owners to accept personal responsibility for collection and disposition of the waste material produced by their pet animals. A typical ordinance instituted recently in a provides that to avoid criminal charges, you must immediately place the waste in a plastic bag, securely tied, then place it in a solid waste container. The enforcement of some ordinance specifies fines, jail time, and probation as penalty for violation. Clearly, the social trend that started years ago in the cities has now spread to the entire country, including some rural areas.

When pet owners are subject to both leash-laws and pooper-scooper ordinances, the owner is obliged to (a) "walk" their pet on a leash and (b) retrieve and dispose of pet wastes when and where the animal decides to relieve itself. This distasteful routine is familiar to all responsible dog owners and many bystanders. Because of the distastefulness of this routine, many less responsible dog owners leave the waste where it lies. A local legislative body may respond to this problem by instituting severe sanctions for such behavior, such as the type of penalties exemplified above. Practitioners in the art respond to the problem by proposing means designed to minimize the unpleasantness of the gathering and disposal of such animal waste.

For instance, the term "pooper-scooper" originally denominated a long-handled mechanical apparatus, which is well-known in the art. A pooper-scooper is used for retrieving dog wastes without soiling the owners' hands. Unfortunately, the first such pooper-scoopers were large and awkwardly-configured devices that were inconvenient to carry and often soiled in use. In using this or later versions and designs of pooper-scoopers, a rigid tray or scoop is employed to scoop up the waste material as best as possible. This design often soiled both the vicinity of the waste and the tray itself. Further, this design and others often require use of both hands, which is extremely difficult when holding a pet's leash.

Even if a disposable bag is placed within the tray, no means are provided for cleanly gathering all of the waste material into the bag. This omission usually obliges the user to employ a twig, branch, or other readily-available item as a tool or scraper for manipulating the waste material from its lie into the bag.

Responsive to this problem, it has been proposed to add a spring-loaded clip to the bottom of a scoop for retaining a disposable plastic bag in position while "scooping" the waste material. While such an improvement may assist in solving the problem of holding the disposable bag in position for use, it may not do anything to improve the gathering operation. The user may still be obliged to grab the nearest twig or other suitable disposable scraper to gather the material into the bag. As every pet owner knows, a simple unaided scooping action relying on collection by gravity alone is not sufficient to gather and retain looser material into a bag held only on one side.

Accordingly, pet-owners (and others) are often confronted with pet waste that can be collected using only an awkward scoop or shovel or, worse, a simple plastic bag for use together with whatever other "tools" may be afforded by their immediate environment. Human nature being what it is, such unpleasant pet waste is commonly left where it lies, creating social, public-health, and legal problems for the pet owner and others. Other solutions known in the art such as, but not limited to, disposable surgical gloves, paper tissues, sandwich bags and the like do little to reduce the well-known unpleasantness of the pet sanitation task. None of these alternatives provides for simple sanitary gathering and bagging of pet waste.

Further, the waste pick-up device should be convenient to carry and easy to operate. Devices that require simultaneous use of both hands presents a problem with respect to retention of the pet leash. If the waste pick-up device requires two hands for use the leash must be put down, which is undesirable since the pet may run away, slipping of the leash onto a wrist, which is undesirable as retention of the leash is difficult and operation of the waste pick-up device is considerably hindered.

Devices such as those described in U.S. Pat. No. 5,370,431 to Henninger et al. and U.S. Pat. No. 5,335,952 to Clapper both describe improvements to the above described pooper-scoopers and waste pick-up devices. However, each of these improvements still presents drawbacks in the complex, often two-handed, manipulation in inverting a bag used therewith, and possible user contact with the waste, both of which are undesirable.

Accordingly, a need exists in the art for a waste pick-up device that solves the above described problems. Further, a need exists for a animal waste collection device that is not awkward to use, needs only one hand to operate, environmentally friendly, and avoids the general distastefulness associated with gathering and disposing of pet waste. These problems and deficiencies are addressed by the invention, as described below.

SUMMARY OF THE INVENTION

An aspect of the invention provides an animal waste collection device. The animal waste collection device allows collection of waste into a bag without soiling a user. The animal waste collection device comprises an elongated handle that comprises an actuator assembly at one end; a pick-up and collection device disposed at the other end of the elongated handle and comprising an elongated cylindrical member and a closure member to define a slot-like aperture in which the closure member is adapted to be moved between an open and closed position to provide access to the interior of the pick-up and collection device through the slot-like aperture; a linkage operably connected at a first end to the actuator assembly and extending between the actuator assembly and the pick-up and collection device; a transmission element operably connected to the linkage at the pick-up and collection device. The transmission element is operably connected to the closure member for transmitting movement from the actuator assembly to move the closure member between open and closed closure member positions. A bag is provided for receiving and storing animal waste and comprises a closed and open end and a slot that is complementary to the slot-like aperture where the open end of the bag is complementary to the elongated cylindrical member. The open end of the bag can be secured to one end of the elongated cylindrical member and the closure member to provide access to the interior of the bag when the actuator assembly moves the closure member to the open position for collecting waste.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 1:
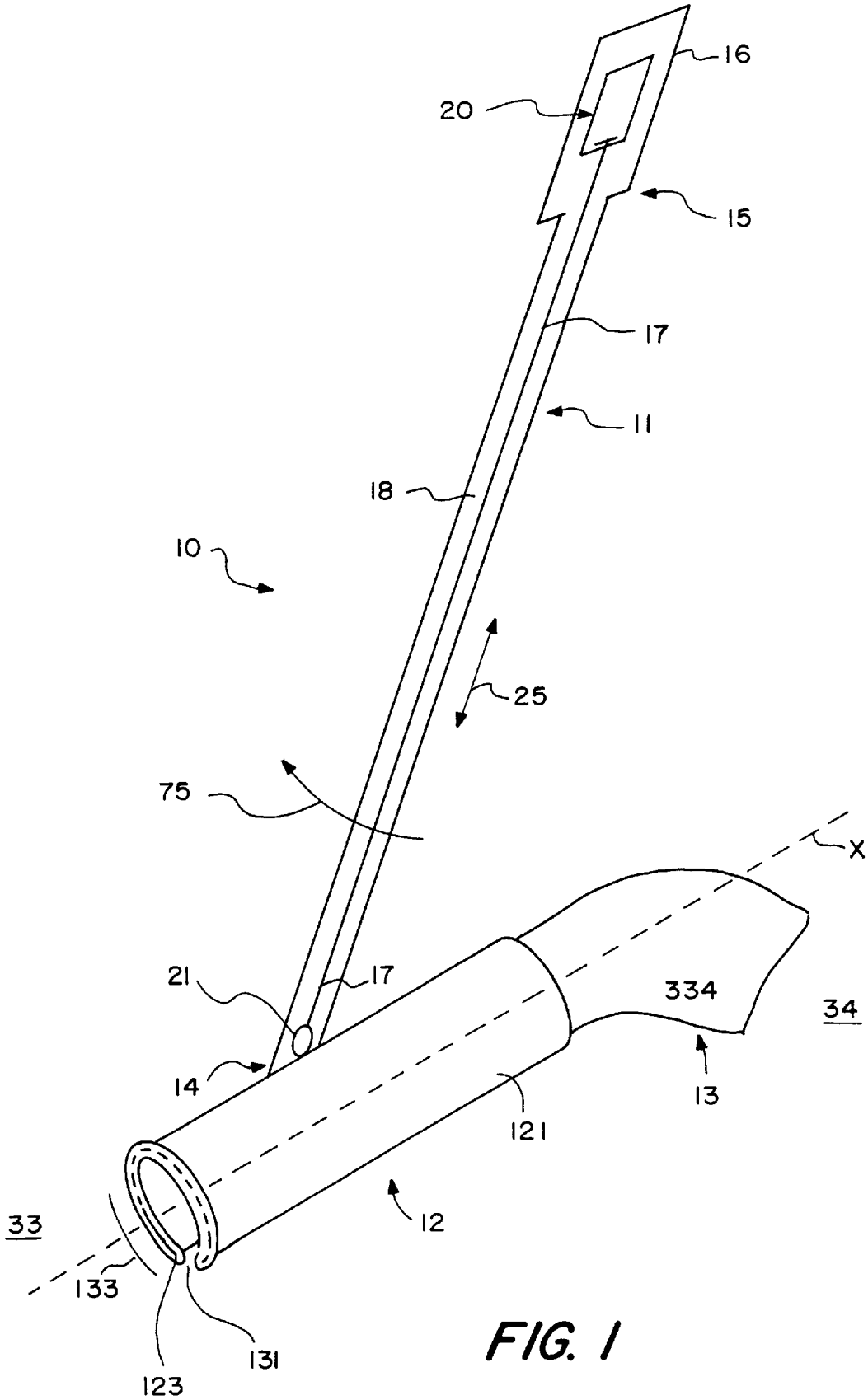
FIG. 1 is a schematic illustration of an animal waste collection device, as embodied by the invention.

An animal waste collection device, as set forth herein, provides a clean, convenient device for collecting animal waste for one-handed animal waste collection. The animal waste collection device 1 is illustrated in FIG. 1, with details of the animal waste collection device illustrated in FIGS. 2–7. The figures set forth exemplary configurations of the animal waste collection device, as embodied by the invention, which are intended for illustrative purposes.

In FIG. 1, the animal waste collection device 10 comprises an elongated handle 11, a pick-up and collection device 12, and a disposable animal waste collection bag 13. The handle 11 is attached to the pick-up and collection device 12 at a first end 14. A second end 15 of the handle 11 comprises a handle assembly with a gripper element 16 (hereinafter "handle assembly") and an actuator assembly 20 for a user to support and operate the animal waste collection device 10, as described hereinafter.

A linkage 17 extends the length of the elongated handle 11. The linkage 17 can extend the length of the elongated handle 11 in an interior 18 of the elongated handle 11. Alternatively, the linkage 17 can extend the length of the elongated handle 11 on an exterior surface of the elongated handle 11, (not illustrated) if the elongated handle 11 comprises a solid elongated handle without an interior. An end of the linkage 17 is operably connected to and extends from the actuation assembly 20, which moves the linkage 17 for operating the pick-up and collection device 12 of the animal waste collection device 10, as described hereinafter. The linkage 17 comprises a second end that is connected to a pick-up and collection device 12 transmission element 21 (hereinafter "transmission element") for moving components of the pick-up and collection device 12, as embodied by the invention and described in detail hereinafter.

Figure 2:
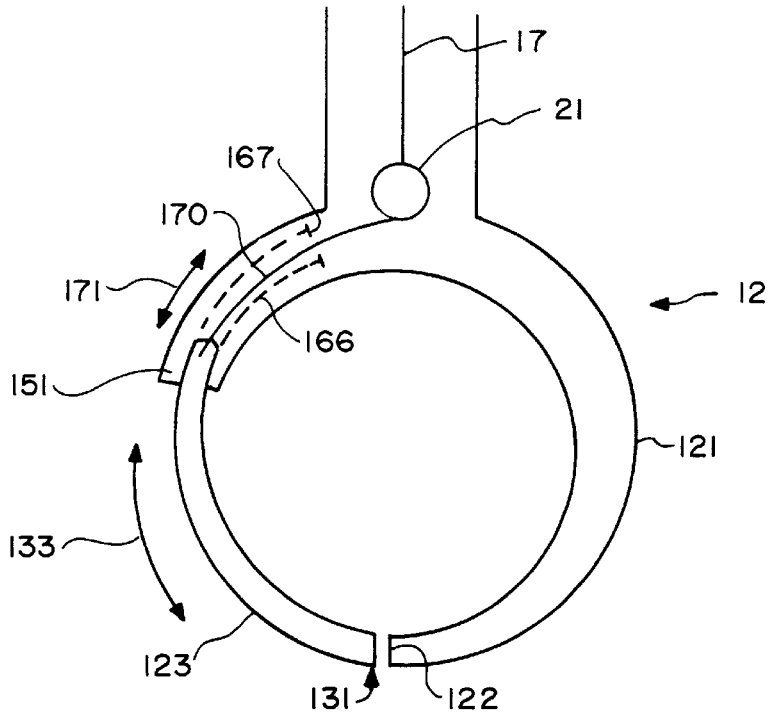
FIG. 2 is a schematic illustration of a pick-up and collection device for an animal waste collection device, as embodied by the invention.
Figure 3:
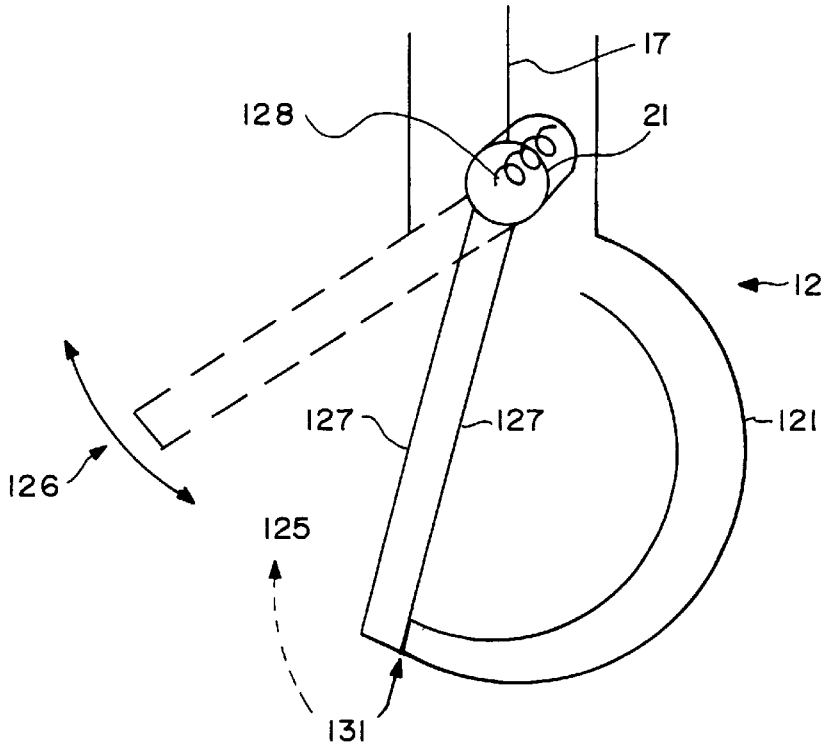
FIG. 3 is a schematic illustration of a further pick-up and collection device for an animal waste collection device, as embodied by the invention.
Figure 4:
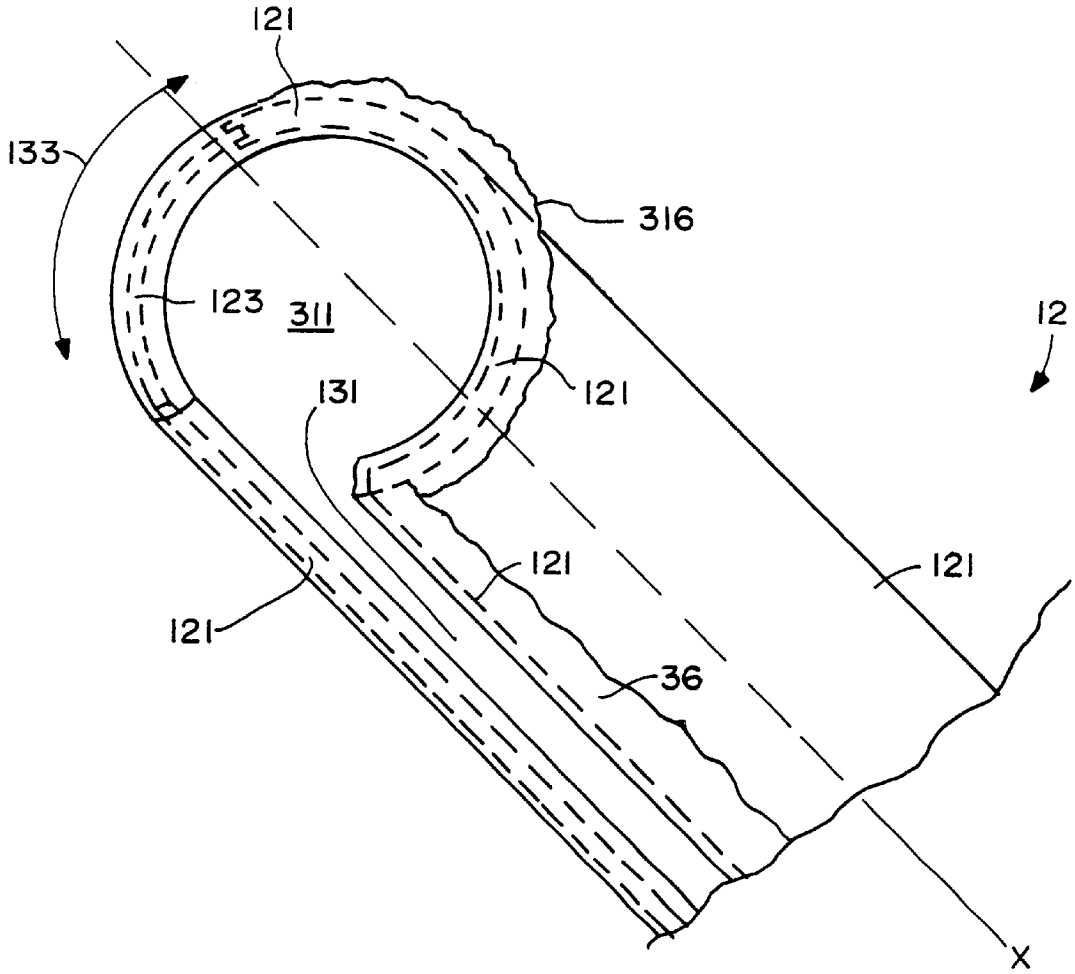
FIG. 4 is a schematic illustration of pick-up and collection device and bag for an animal waste collection device, as embodied by the invention.

The pick-up and collection device 12 is illustrated in FIG. 1 and in further detail in FIGS. 2–4. The pick-up and collection device 12 comprises an elongated cylindrical member 121 and a pick-up and collection device closure member. The pick-up and collection device closure member (hereinafter "closure member") comprises a complementary configuration with the elongated cylindrical member 121 to close the pick-up and collection device 12 in a closure member closed position.

FIGS. 1, 3 and 4 illustrate the pick-up and collection device 12 of the animal waste collection device 10, as embodied by the invention, comprising a closure member 123 with a curved configuration. Alternatively, FIG. 3 illustrates a closure member 125 of pick-up and collection device 12 comprising a generally planar configuration. These closure members, 123 and 125, respectively, will be described in further detail hereinafter.

The elongated cylindrical member 121 is provided with a slot-like aperture 131 (FIGS. 1 and 4) that extends for a distance along a longitudinal axis x of the pick-up and collection device 12. The slot-like aperture 131 can extend along the pick-up and collection device 12 for a distance less than or equal to the entire distance of the pick-up and collection device 12. The slot-like aperture 131 can be opened and closed by moving the closure member of the pick-up and collection device 12.

In the open position, the slot-like aperture 131 exposes the interior elongated cylindrical member 121 of the pick-up and collection device 12. Thus, animal waste can enter the elongated cylindrical member 121 and be captured by the animal waste collection device 10, as described in the operation of the animal waste collection device 10 hereinafter. In the closed position, the slot-like aperture 131 effectively closes the pick-up and collection device 12 so to define an essentially closed elongated cylindrical member 121 with a closed end 34 of the bag 13 closing off the pick-up and collection device 12. An open end 33 of the bag 13 for the animal waste collection device 10 can remain open in either position of the closure member.

As described above, the pick-up and collection device 12 comprises a closure member, such as on of the closure members illustrated in FIGS. 2 and 3. The closure members are moved between their closed and open positions through movement imparted to it via the linkage 17 through the pick-up and collection device transmission element 21. The linkage 17 by the user of the animal waste collection device 10 by using the actuation assembly 20 in the second end 15 of the elongated handle 11. A description of each respective closure member and its movement will now be provided.

The closure member 123 with a curved configuration (hereinafter "curved closure member"), as illustrated in FIGS. 1, 2 and 4, comprises a circular segment element. The curved closure member 123 moves in the direction of arrow 133 between a closed position, for example as illustrated in FIG. 2, in which the curved closure member 123 essentially mates with an periphery or edge 122 of the elongated cylindrical member 121 and an open position. Thus, as illustrated, the pick-up and collection device 12 will in the closed position, for all extensive purposes, form a total cylinder. The slot-like aperture 131 will then be closed. Waste should not be able to enter the pick-up and collection device 12 through slot-like aperture 131 when the curved closure member 123 is in its closed position. Further, any waste in the animal waste collection device 10, for example, but not limited to in the elongated cylindrical member 121, will not be able to drop out of the elongated cylindrical member 121 or escape therefrom when the curved closure member 123 is in its closed position.

The curved closure member 123 can be moved to its open position by a user of the animal waste collection device 10 operating the actuation assembly 20. Exemplary configurations of the actuation assembly 20 will be described with respect to FIGS. 5 and 6. The following description will refer in general to an actuation assembly 20, and any actuation assembly within the scope of the invention can be used for moving the curved closure member 123.

The user of the animal waste collection device 10 moves the actuation assembly 20 to move the curved closure member 123 to its open position. The actuation assembly 20 is connected to the linkage 17, so that when the actuation assembly 20 is operated by a user, the linkage 17 is moved along the elongated handle 11 in the direction of arrow 25. The linkage 17 is moved in a direction toward the actuation assembly 20. The linkage 17 then acts in conjunction with the transmission element 21 to impart movement to the curved closure member 123.

The transmission element 21 comprises a mechanical device that can transfer movement from the linkage 17 to the curved closure member 123. The movement is transferred between the linkage 17 and the curved closure member 123 by a linkage extension 170 (FIG. 2) that is operatively connected to the curved closure member 123 to transmit movement therebetween.

Exemplary configurations of the transmission element 21, linkage 17, and linkage extension 170 can comprise, but are not limited to, the transmission element 21 comprising a post, in which the linkage 17 simply extends around the post transmission element 21 to the curved closure member 123. The linkage 17 connects with, is integrally connected with, or is one-piece with the linkage extension 170 that can be connected to the curved closure member 123. Thus, a movement of the linkage 17 moves the linkage extension 170, that results in movement of the curved closure member 123.

Alternatively, the transmission element 21 can comprise at least one of a gear, slip transmission, manual and automatic transmissions, pinion, transmission, interconnected linkages and gears, and combinations thereof. The linkage 17 may be integral with, connected therewith, or one-piece with the linkage extension 170 in conjunction with the transmission element 21. Regardless of the connection between the transmission element 21, linkage 17, and linkage extension 170, movement of the linkage 17 will move the linkage extension 170 about the transmission element 21. This connection and associated movement will result in the curved closure member 123 or the planar closure member 125 being moved, in a manner as discussed hereinafter.

The linkage 17 may comprise a cable formed from any appropriate material metals, plastics, natural materials (strings, yarns, and the like), chains, and combinations thereof. The connections of the linkage 17 to the transmission element 21 and the actuation assembly 20, and the connection of the linkage extension 170 to the at least one of the transmission element 21 and the linkage 17 (if integrally connected thereto) can comprise any appropriate connection between the respective elements.

The curved closure member 123, as illustrated, moves within an interior 151 of the elongated cylindrical member 121 of the pick-up and collection device 12. The curved closure member 123 moves therein between an open position to a closed position against a force of a biasing element 166. The biasing element 166 is disposed within the interior 151. The biasing element 166 has one end disposed against the curved closure member 123 and another end disposed against a stop 167. The stop 167 acts to position the biasing element 166 and can also act to limit the movement of the curved closure member 123 in the interior 151 of the elongated cylindrical member 121 of the pick-up and collection device 12.

The linkage 17 or the linkage extension 170 is connected to the closure member, for example one of the curved closure member 123 and the planar closure member 125. In the embodiment of the animal waste collection device 10 comprising the curved closure member 123, the linkage extension 170 is connected to the curved closure member 123, on an opposite end of the linkage extension 170 from the transmission element 21.

In operation, the actuation assembly 20 moves the linkage 17 in a direction toward the actuation assembly 20, as indicated by the arrow 25. Movement of the linkage 17 will cause the transmission element 21 to move the linkage extension 170 toward the transmission element 21 in the direction of arrow 171. Movement of the linkage extension 170 toward the transmission element 21 in the direction of arrow 171 will cause the curved closure member 123 to move counterclockwise (FIG. 2) in the interior 151 against the force of the biasing element 166 to open the slot-like aperture 131 in the pick-up and collection device 12. Accordingly, the pick-up and collection device 12, elongated cylindrical member 121, and the bag 13 associate therewith, will be open. The slot-like aperture 131 will then be disposed to accept any animal waste.

The user of the animal waste collection device 10 will position the pick-up and collection device 12 and bag 13 near the waste. For example, the user will move the pick-up and collection device 12 directly over and around the waste. Then, the user will release the actuation assembly 20, and the linkage 17 will then move linkage extension 170 in a counter-clockwise direction and with the force of the biasing element 166. The biasing element 166 will assist the movement of the curved closure member 123 in the counterclockwise direction and thus close the slot-like aperture 131. Therefore, the pick-up and collection device 12, elongated cylindrical member 121, and bag 13 will then contain the waste in the interior 18 of the bag 13 and the elongated cylindrical member 121. Once the waste is disposed within the pick-up and collection device 12, elongated cylindrical member 121, and bag 13, a user can then tip the animal waste collection device 10 in the direction of the arrow 75 so the waste can fall toward the closed end 34 (FIGS. 1 and 7) of the bag 13.

The animal waste collection device 10 comprises a planar closure member 125, will now be described with respect to FIG. 3. In FIG. 3, like elements are provided with similar reference characters, and the above description of these features is applicable herein and reiterated in this discussion of the animal waste collection device 10, as embodied by the invention. FIG. 3 illustrates a planar closure member 125, in which the term planar means that the closure member 125 comprises essentially straight edges 127, however, the edges 127 may comprise a sight curvature to match the curvature of the elongated cylindrical member 121 of the pick-up and collection device 12.

The linkage 17 in FIG. 3 (as in the other embodiments of the invention, as embodied by the invention) is connected to the transmission element 21. The transmission element 21 transmits movement from the linkage 17 therethrough to the planar closure member 125. The transmission element 21 for the animal waste collection device 10 with a planar closure member 125 can comprise any appropriate transmission element, such as but not limited to one of a gear, slip transmission, pinion, transmission, manual and automatic transmissions, interconnected linkages and gears, other types of clutch-controlled elements, and combinations thereof that are capable of transmitting linkage 17 movement to the planar closure member 125.

With the animal waste collection device 10 comprising a planar closure member 125, the linkage 17 and transmission element 21 transmits movement to the planar closure member 125 to move the planar closure member 125 in the direction of arrow 126 between open and closed positions.

The motion of the planar closure member 125 in the direction of arrow 126 is similar in purpose as the movement in direction 133, as described above with reference to FIG. 2 and the curved closure member 123.

To collect waste with the animal waste collection device 10 with the planar closure member 125, as embodied by the invention in FIG. 3, the elongated cylindrical member 121 of the pick-up and collection device 12 is disposed above the waste. The actuator assembly is operated to move the linkage 17 in the direction of arrow 25. The movement of the linkage 17 is transmitted to the planar closure member 125 through the transmission element 21. The transmission element 21 imparts movement to the planar closure member 125 to move the planar closure member 125 in the direction of arrow 126. When the planar closure member 125 has been moved to open the slot-like aperture 131, the user of the device positions the pick-up and collection device 12 over and slightly askew to the waste (the waste is disposed to the left of the planar closure member 125 in FIG. 3). The user then lowers the animal waste collection device 10 with respect to the waste so the waste is disposed between the now-moved planar closure member 125 and the elongated cylindrical member 121, and within the opened slot-like aperture 131, as discussed above.

Next, the user of the animal waste collection device 10 causes the actuator assembly 20 to move the linkage 17, in such a manner to cause the transmission element 21 to move the planar closure member 125 toward the elongated cylindrical member 121 and close the slot-like aperture 131. Thus, the waste is collected within the bag 13 of the animal waste collection device 10, without causing the waste to be contacted by the user, regardless of potential use by a user of protective gloves, bags, and other such devices.

The animal waste collection device 10 that comprises the planar closure member 125 may also comprise a biasing element 128. The biasing element 128 may bias the planar closure member 125 toward its closed position, and thus the movement imparted to the planar closure member 125 by the transmission element 21 and the linkage 17 moves the planar closure member 125 against the force of the biasing element 128. The figures illustrate the biasing element 128 as a coil spring, however, this configuration of the biasing element 128 is merely exemplary of biasing elements within the scope of the invention. Other such biasing elements, such as but not limited to, leaf springs, torsion springs, tension springs, and the like may employed for the biasing element 128, as with the biasing element 166.

In the animal waste collection device 10, as illustrated in FIG. 3, the transmission element 21 and the planar closure member 125 may be interconnected so that when movement of the transmission element 21 is moved by the linkage 17, the movement may be directly transmitted to the planar closure member 125. For example, but not limited to, the linkage 17 and transmission element 21 may be rigidly interconnected by mechanical connectors, so movement is directly transmitted. Alternatively, the linkage 17 and the transmission element 21 may be connected by a gear, clutch, pinion, or other such transmission structure so the movement from the linkage 17 is transmitted to the planar closure member 125, to operate the animal waste collection device 10, as embodied by the invention.

Figure 5:
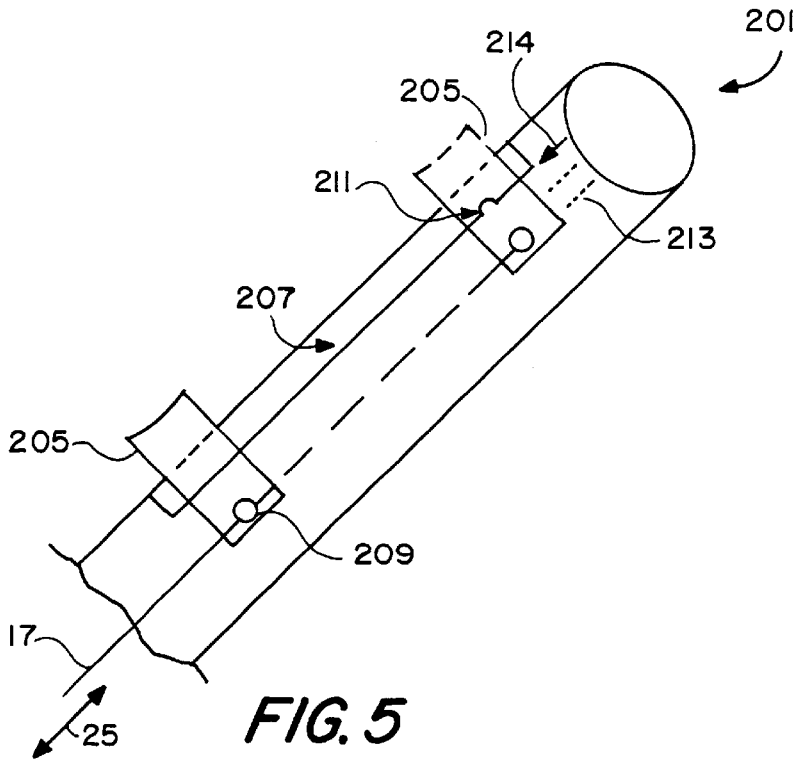
FIG. 5 is a schematic illustration of a handle and actuator assembly of an animal waste collection device, as embodied by the invention.
Figure 6:
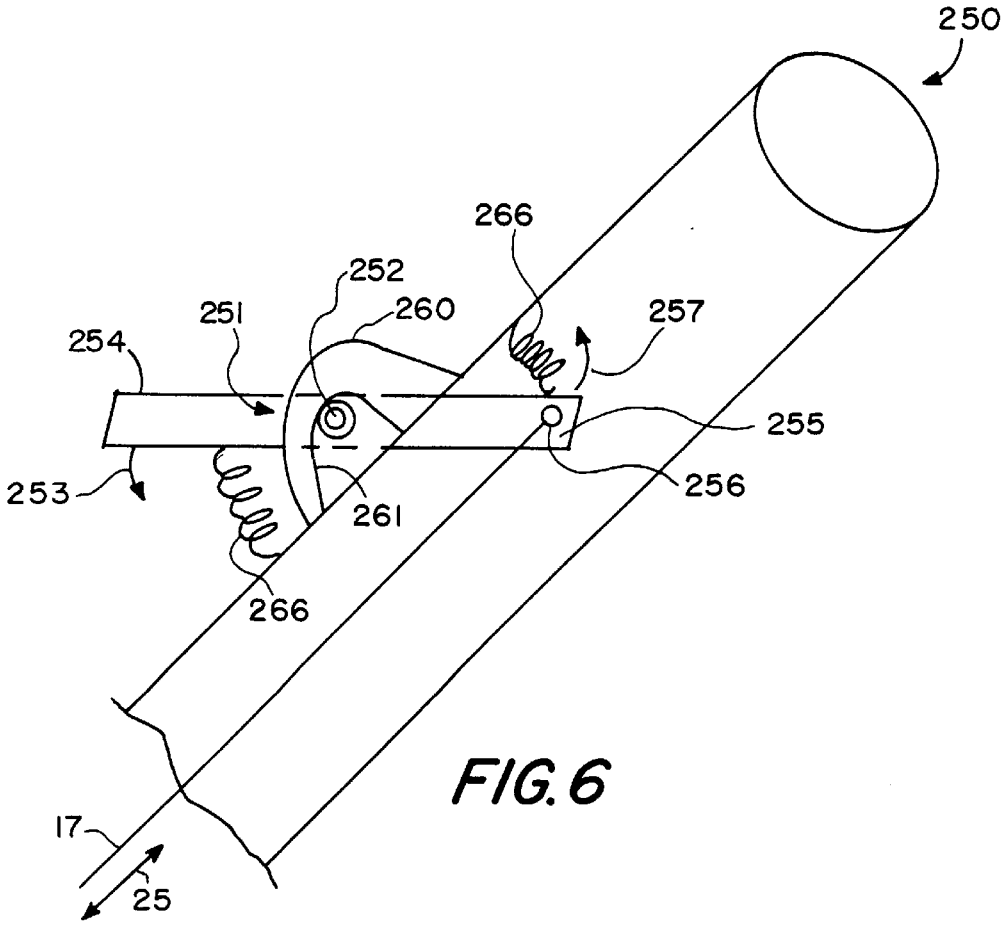
FIG. 6 is a schematic illustration of a further and actuator handle assembly of an animal waste collection device, as embodied by the invention.

FIGS. 5 and 6 illustrate exemplary configurations for an actuator assembly 20 within the scope of the invention. Each actuator assembly, 201 and 250, as illustrated in FIGS. 5 and 6, respectively, are merely exemplary of the actuator assemblies within the scope of the invention that can impart movement to the linkage 17, as described above. These configurations are not intended to limit the invention in any manner.

The actuator assembly 201 of FIG. 5 comprises a button actuator assembly 201. The button actuator assembly 201 comprises a hand or finger slidable movable button 205. The button 205 is connected to the linkage 17 at connection 209, in which movement of the button 205 imparts movement to the linkage 17. The button 205 is movable by a user of the animal waste collection device 10 to transmit movement to the linkage 17 in the direction of arrow 25. The button 205 is illustrated in a first position (solid lines) in which the linkage 17 has not been moved to open the closure member. The button 205 is movable in a slot 207 in the second end 15 of the elongated handle 11 by a hand or finger of the user to a second position (illustrated in phantom in FIG. 5). In the second position, the button 205 has moved the linkage 17 to open the slot-like aperture 131 of the pick-up and collection device 12 for collecting waste. The button 205 can be moved against a return force of a biasing element 213, which acts to bias the button 205 in the direction of arrow 214 toward the first position, and the closed position of the slot-like aperture 131.

The actuator assembly 201 can comprise a detent 211 to maintain the button 205 in the second position. The detent 211 can comprise any appropriate detent structure that can act to maintain the button 205 in the second position so the slot-like aperture 131 is open, and the animal waste collection device 10 can collect waste. For example, and in no way limiting of the invention, the detent 211 can comprise at lest one of a self-locking detent, a latch, a spring-biasing detent, a manually-actuated detent (in which the user moves the detent 211 into a latching position with the button 205), and combinations thereof. The above-described detents are merely exemplary of the detent structures within the scope of the invention, and should not be construed as limiting of the invention.

Further, if a biasing element 213 is provided to return the button 205, the detent 211 can hold the button in the second position including against the return force of the biasing element 213 (if provided). Thus, the user of the animal waste collection device 10 need only move the button 205 to the second position, at which time the detent 211 can hold the button 205 in the second position. The user can pick up waste and then may release the detent 211 (if a manually actuated detent) by simply applying pressure to the button 205 to overcome the detent 211. Therefore, the button 205 can return to the first position in which the slot-like aperture 131 is closed.

Alternatively, as embodied by the invention, a lever actuator assembly 250 as illustrated in FIG. 6 may be provided. The lever actuator assembly 250 of FIG. 6 is moved by a hand or finger of the user to move the lever 251 about a pivot 252 in the direction of arrow 253. The lever 251 comprises a first end 254 at which end the user of the animal waste collection device 10 provides a force to move the lever 251 about the pivot 252. The pivot 252 can be formed integral with the first end 15 of the elongated handle 11, and alternatively, the pivot 252 can be formed with a boss 260 on the first end 15 of the elongated handle 11, in which the boss 260 enhances the pivoting movement and degree of possible pivoting of the lever 251.

Once the lever 251 is moved about its pivot 252, the other end 255 of the lever 251 is moved in the direction of arrow 257. The other end 255 comprises a connection 256 of the lever 251 t the linkage 17, so that when the other end 255 is moved in the direction of arrow 257, the linkage is moved in the direction indicated the arrow 25. Thus, movement can be transmitted to the closure member to open the slot-like aperture 131, and the user of the animal waste collection device 10 can collect waste, as needed.

The actuator assembly 250 of FIG. 6 can also comprise a biasing element to move the actuator assembly 250 in a position in which the linkage 17 opens the slot-like aperture 131. For example, the actuator assembly 250 can comprise a spring 261 that is included at the pivot 252 to move the first end 254 of the lever 251 in a direction opposite the arrow 253. Alternatively, the actuator assembly 250 may comprise at least one biasing element 266 that is disposed proximate either end, 254 and 255, of the lever 251. Further, both of the biasing elements 266 illustrated in FIG. 6 may be provided together, in which the biasing elements 266 act to return the lever 251 to an unbiased position. As a further alternative within the scope of the invention, the actuator assembly 250 may comprise each respective biasing element all acting in cooperation with one another.

Figure 7:
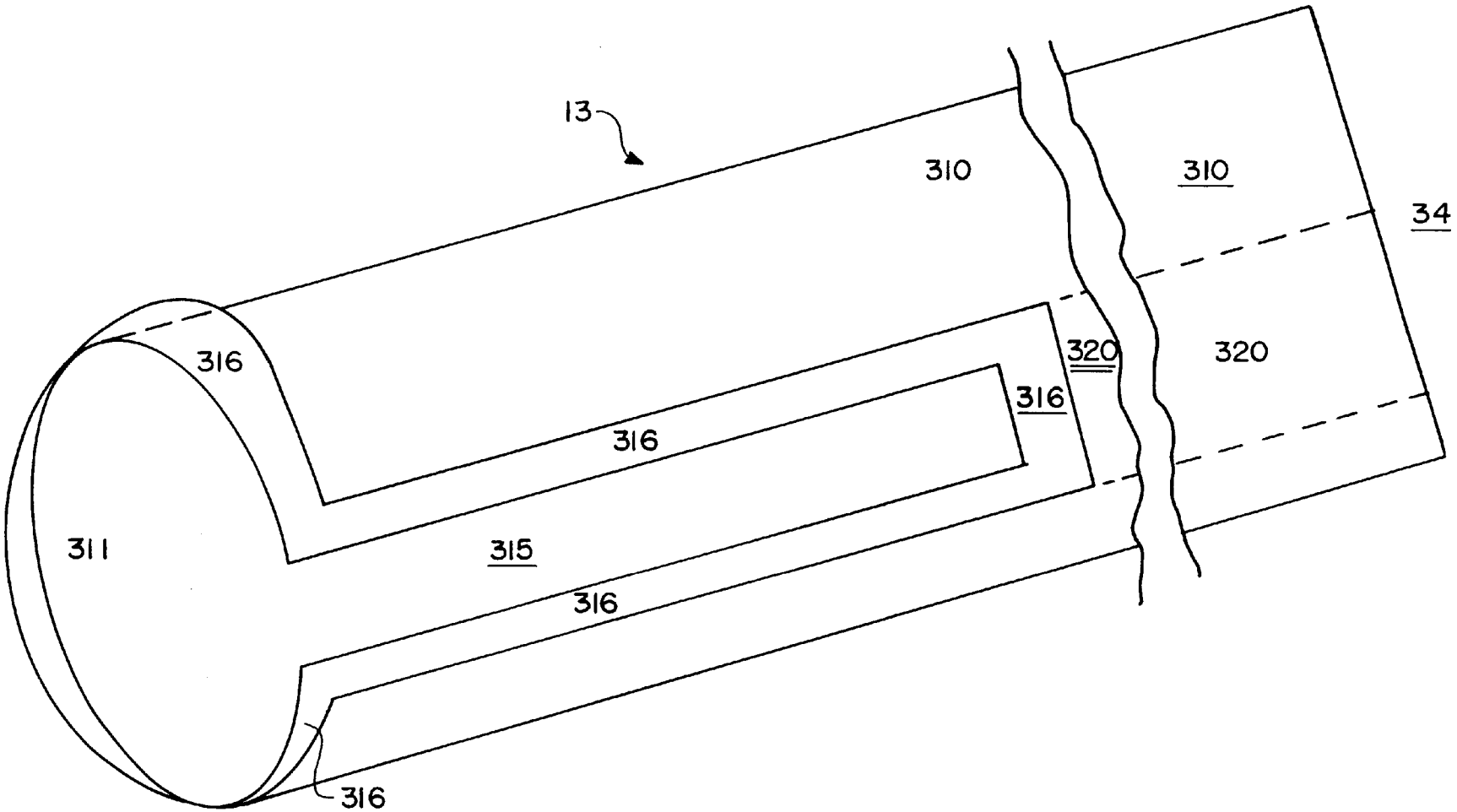
FIG. 7 is a schematic illustration of a bag for use with a animal waste collection device, as embodied by the invention.

The bag 13 of the animal waste collection device 10 is illustrated in FIGS. 4 and 7. The bag 13 comprises an elongated body 310, in which the body is at least equal to the length of the elongated cylindrical member 121. Further, the bag 13 should be longer than the elongated cylindrical member 121, as illustrated in FIG. 1, to provide a pouch-like area 334 to hold waste after collection. The bag 13 comprises a structure that conforms to the elongated cylindrical member 121 and is adapted to capture the waste, without causing the user of the device to become soiled by the waste. Further, the bag 13 can be disposable so that the waste need never be touched by a user.

The bag 13 can comprise any generally material that is non-permeable to animal waste. For example, the bag 13 can comprise materials, such as but not limited to, plastics, rubber, synthetic materials, fabric, coated paper, paper, and combinations thereof. The bag 13 can comprise biodegradable materialize to present an environmentally friendly construction.

The bag 13 comprises at least two portions, a first portion that cooperates with the elongated cylindrical member 121 for capturing waste, and a second portion or pouch area 334 that is disposed spaced from the elongated cylindrical member 121 for storing collected waste. The bag 13 may comprise at least one first portion, which is provided with structure that is pliable and stretchable to permit an open end 311 of the bag 13 to be attached and retained on end 33 of the elongated cylindrical member 121. Further, the least one first portion that is pliable and stretchable to permit an open end 311 of the bag 13 to be attached and retained on end 33 of the elongated cylindrical member 121 extends to the rear end 212 of the elongated cylindrical member 121 and thereat defines a further The open end 311 of the bag 13 defines an opening that is equal to or slightly smaller than the opening of the elongated cylindrical member 121 at the end 33. Further, the first portion of the bag 13 at the rear end 212 of the elongated cylindrical member 121 is also slightly smaller that the periphery of the elongated cylindrical member 121 at the rear end 212. Thus, as described hereinafter, the end 311 of the bag 13 may be manipulated by a user of the animal waste collection device 10 to secure the bag 13 on the elongated cylindrical member 121. Also, a portion of the bag 13 that is disposed proximate the rear end 212 of the elongated cylindrical member 121 may be manipulated by a user of the animal waste collection device 10 to secure the bag 13 on the elongated cylindrical member 121 at an overlapping flap portion 231. Similarly, a portion of the bag 13 that is disposed proximate the slot-like aperture 131 of the elongated cylindrical member 121 may be manipulated by a user of the animal waste collection device 10 to secure the bag 13 on the elongated cylindrical member 121 at an overlapping flap portion 233 (FIG. 1). Therefore, the bag 13 at locations where the bag 13 is disposed proximate the elongated cylindrical member 121 will maintain an open configuration thus facilitating collection of waste into the animal waste collection device 10. Moreover, the bag 13 may comprise other portions, such as but not limited to flaps, folds, pleats, folding joints, and combinations thereof, that cooperate with the elongated cylindrical member 121 to maintain the bag 13 in an open configuration wherein the interior of the bag is open for collecting waste.

Further, the bag 13 comprises a closed end 34 that is opposed to the open end 311 and defines the pouch-like area 334. The bag 13, as illustrated in the figures and as embodied by the invention, also comprises a slot 315, in which the slot 315 corresponds in general size and shape to the slot-like aperture 131 of the pick-up and collection device 12. The periphery 316 of the bag 13 comprises a flap-like structure, in which the flap-like structure extend over the bag 13 where it cooperates with and is attached to the periphery or edges 121 of the pick-up and collection device 12 and the slot-like aperture 131, as described herein. Further, the bag 13 may comprise at least one pleat in area 320 of the bag, in which the at least one pleat in the area 320 facilitates movement of the bag 13 at the slot when the slot-like aperture 131 is opened or closed.

At least the periphery 316 of the bag 13 near its opening 311 comprises a pliable, stretchable material that can be elongated from its rest position when the bag 13 is not in cooperation with the animal waste collection device 10 to secure the bag 13 on the animal waste collection device 10. For example, and in no way limiting of the invention, the periphery 316 may comprise rubber, plastic, pleated materials, and the like. Thus, for attaching a clean bag 13 to a animal waste collection device 10, a user positions the bag 13 within elongated cylindrical member 121 of the animal waste collection device 10. The slot 315 of the bag 13 is generally aligned with the slot-like aperture 131 of the elongated cylindrical member 121. A user then grasps the periphery 316 of the bag 13 over the edges 121 of the elongated cylindrical member 121. The user then releases the periphery 316 of the bag 13, at which time the periphery 316 of the bag 13 attempts to return to its un-stretched position, and securely attaches itself to the elongated cylindrical member 121 (FIG. 4).

The bag 13 will retain itself on the elongated cylindrical member 121 even when a closure member, either the curved closure member 123 or the planar closure member 125, due to the elasticity of the periphery 316. To remove a bag 13 that contains waste, the user of the animal waste collection device 10 merely grabs a portion of the bag 13 remote from the end 311, for example at the end of the elongated cylindrical member 121 remote from the end 33 of the elongated cylindrical member 121, and pulls the bag 13 off of the animal waste collection device 10. The filled bag 13 may then be properly disposed of, without soiling a user.

Therefore, the animal waste collection device, as embodied by the invention, can provide a convenient, one-handed device for the neat and easy collection of animal waste. The animal waste collection device, as embodied by the invention, overcomes the above-noted deficiencies of known pooper-scoopers, and also avoids soiling of the animal waste collection device features. Thus, a user of the animal waste collection device need not clean the animal waste collection device after each use. Of course, the animal waste collection device, as embodied by the invention, comprises materials that are readily cleaned, such s but not limited to, plastic, metals, and combinations thereof. Further, given the configuration of the bag 13 including the pouch-like area 334, the animal waste collection device 10 can be sued for multiple pick-up operations, with one bag 13.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other component of the described and illustrated embodiments.

What is claimed:

1. An animal waste collection device for collecting waste into a bag without soiling a user of the animal waste collection device, the animal waste collection device comprising:

an elongated handle, the elongated handle comprising an actuator assembly at one end of the elongated handle;

a pick-up and collection device disposed at an end of the elongated handle from the actuator assembly, the pick-up and collection device comprising an elongated cylindrical member and a closure member, the elongated opened-ended cylindrical member and closure member define a slot-like aperture, the closure member adapted to be moved between an open and closed position, the open position adapted to provide access to the interior of the pick-up and collection device through the slot-like aperture;

a linkage operably connected at a first end to the actuator assembly and extending between the actuator assembly and the pick-up and collection device;

a transmission element operably connected to the linkage at the pick-up and collection device, the transmission element also being operably connected to the closure member for transmitting movement from the actuator assembly, through the linkage and the transmission element to the closure member to move the closure member between open and closed closure member positions; and a bag for receiving and storing animal waste collected by the animal waste collection device, the bag comprising a closed end and an open end opposed to the closed end, the bag also comprising a slot that is complementary to the slot-like aperture of the elongated cylindrical member, the open end of the bag being complementary to the elongated cylindrical member of the pick-up and collection device, wherein the open end of the bag can be secured to one end of the elongated cylindrical member and the closure member to provide access to the interior of the bag when the actuator assembly moves the closure member to the open position for collecting waste, further wherein the animal waste collection device can collect waste without soiling a user of the animal waste collection device nor soiling the animal waste collection device.

2. A device according to claim 1, wherein the bag comprises a periphery, the periphery comprising a flap, the flap adapted to extend over and attach to edges of the pick-up and collection device.

3. A device according to claim 2, wherein the bag comprises an open end and a closed end, the open end comprising a pliable and stretchable material, in which the material is adapted to extend over and attach to edges of the pick-up and collection device.

4. A device according to claim 1, wherein the bag comprises at least one of plastics, rubber, coated papers, paper, and combinations thereof.

5. A device according to claim 1, wherein the bag comprises at least one pleat disposed near the slot for facilitating movement of the bag when the closure member is open and closed.

6. A device according to claim 1, wherein the linkage comprises a linkage extension that leads from the transmission element to the closure member, wherein movement of the linkage can be transmitted to the linkage extension to move the closure member.

7. A device according to claim 1, wherein the actuator assembly is movable from a first position that corresponds to a closed position of the pick-up and collection device to a second position that corresponds to an open position of the pick-up and collection device.

8. A device according to claim 7, wherein the actuator assembly comprises a latch to hold the actuator assembly in the first position.

9. A device according to claim 7, wherein the actuator assembly comprises a button that is movable in a slot in the actuator assembly between the first and second positions.

10. A device according to claim 1, wherein the actuator assembly comprises a lever that is movable between the first and second positions.

11. A device according to claim 1, wherein the transmission element comprises at least one of gear, slip transmission, manual and automatic transmissions, pinion, transmission, interconnected linkages and gears, and combinations thereof.

12. A device according to claim 1, wherein the closure member comprises a curved closure member that is moveable in an interior of the elongated cylindrical member.

13. A device according to claim 1, wherein the closure member comprises a substantially planar closure member, the substantially planar closure member mating with edges of the elongated cylindrical member to close the pick-up and collection device.

14. A device according to claim 1, wherein the animal waste collection device further comprises biasing elements to bias the closure member to the closed position.

15. A device according to claim 1, wherein the bag comprises a substantially similar shape to the elongated cylindrical member and the closure member.

16. A device according to claim 1, wherein the bag comprises a pouch area at the closed end of the bag, wherein the waste that is collected can be stored in the pouch area of the bag.

* * * * *